US008051890B2

(12) United States Patent
Broyan

(10) Patent No.: US 8,051,890 B2
(45) Date of Patent: Nov. 8, 2011

(54) EXPANDABLE GATE

(76) Inventor: Frederick Kenneth Broyan, Berwick, PA (US)

( * ) Notice: Subject to any disclaimer, the term of this patent is extended or adjusted under 35 U.S.C. 154(b) by 532 days.

(21) Appl. No.: 12/313,550

(22) Filed: Nov. 21, 2008

(65) Prior Publication Data

US 2010/0126076 A1 May 27, 2010

(51) Int. Cl.

| | |
|---|---|
| ***E05D 15/00*** | (2006.01) |
| ***E06B 0/92*** | (2006.01) |
| ***E06B 3/12*** | (2006.01) |
| ***E06B 9/00*** | (2006.01) |
| ***E06B 3/48*** | (2006.01) |
| ***E06B 7/086*** | (2006.01) |
| ***E06B 3/92*** | (2006.01) |
| ***E06B 3/68*** | (2006.01) |
| ***E06B 7/00*** | (2006.01) |
| ***E06B 9/01*** | (2006.01) |

(52) U.S. Cl. ..... 160/201; 49/55; 160/218; 160/229.1; 160/159; 160/144

(58) Field of Classification Search ..... 160/136–165, 160/192, 201, 218, 180, 186, 222–228; 49/55, 49/57, 366, 404; 267/260, 351, 36.1
See application file for complete search history.

(56) References Cited

U.S. PATENT DOCUMENTS

| | | | | | |
|---|---|---|---|---|---|
| 67,143 | A | | 7/1867 | Snead | |
| 583,235 | A | * | 5/1897 | McCormick | 160/159 |
| 1,644,285 | A | * | 10/1927 | Smith | 160/150 |
| 1,790,027 | A | | 1/1931 | Shonnard | |
| 2,348,561 | A | | 5/1944 | Mutch | |
| 2,433,763 | A | | 12/1947 | Kiesling | |
| 2,722,979 | A | * | 11/1955 | Janowitz | 160/131 |
| 2,990,880 | A | | 7/1961 | Catalano et al. | |
| 3,213,555 | A | | 10/1965 | Horn | |
| 3,722,140 | A | | 3/1973 | Newton | |
| 3,724,527 | A | * | 4/1973 | Johns | 160/368.1 |
| 4,816,310 | A | * | 3/1989 | Truyens | 428/12 |
| 5,373,916 | A | * | 12/1994 | Kiviniemi et al. | 187/336 |
| 5,535,803 | A | * | 7/1996 | Pretorius | 160/136 |

* cited by examiner

*Primary Examiner* — Blair M Johnson
*Assistant Examiner* — Jeremy Ramsey
(74) *Attorney, Agent, or Firm* — Thomas R. Shaffer, Esq.

(57) ABSTRACT

An expandable gate is described which includes a top horizontal guide rod, a bottom horizontal guide rod and vertical bar members extending from the top guide rod to the bottom guide rod. Each of the bar members has a top guide rod slot and a bottom guide bar slot and the top guide rod extends through each of the top guide rod slots and the bottom guide rod extends through each of the bottom guide rod slots. The vertical bar members may slide horizontally on guide rod members between an open expanded position where the bars are spaced further apart from one another and a closed collapsed position where the bars are closer together. The bar members each have spring connection holes at spaced locations between said top guide rod slot and said bottom guide rod slot. Elongated flexible tension bar springs are provided which lie flat when no forces are applied to the springs. Each of the bar spring have a central opening and have an elongated upper end opening and an elongated lower end opening. The springs have overlapping ends are positioned between adjacent bar members. First connectors rigidly attach a central portion of each spring to a bar member. Second connectors slidingly attach an upper end portion and a lower end portion of each spring to a bar member and the springs urge the vertical bar members to move closer together to the collapsed closed position.

18 Claims, 8 Drawing Sheets

FIG. 7c
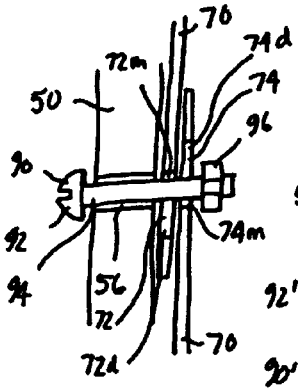
FIG. 7d
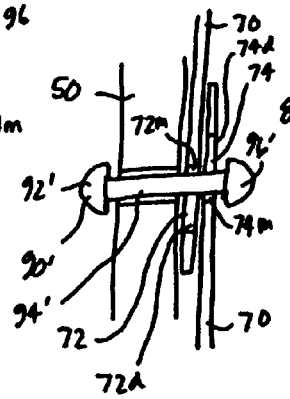
FIG. 7a
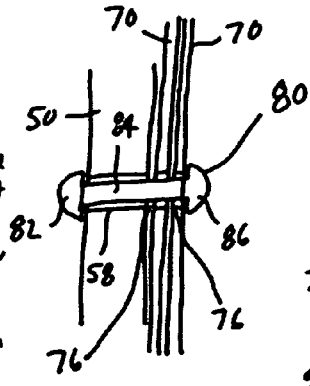
FIG. 7e
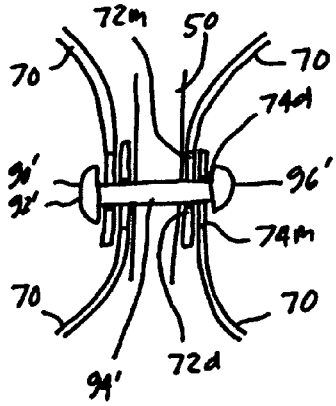
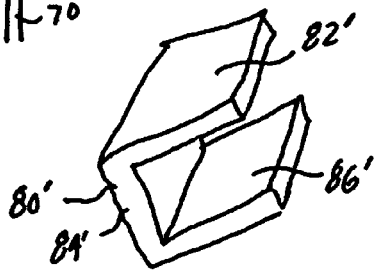
FIG. 7b

EXPANDABLE GATE

BACKGROUND OF THE INVENTION

1. Field of the Invention

The present invention relates to an expandable gate. More specifically, it relates to an expandable gate which utilizes spring members to hold adjacent vertical bar members in a compact collapsed position.

2. Description of the Prior Art

A variety of expandable gate structures have been proposed over the years. Examples of some of such prior art structures include the following. Snead, U.S. Pat. No. 67,143 discloses a very early version of a collapsible gate the type which is now known as a "lazy tongs" door or gate. Snead also teaches the use of an intermediate washer C to prevent the rubbing of the bars and slots D to allow for the extension and limit of the same. This patent teaches that the general field of collapsible gates was known at least as early as 1867.

Shonnard, U.S. Pat. No. 1,790,027 discloses a safety device for elevator doors which essentially provides guards or curtains 14. This patent was selected because it also shows in FIG. 1 a well known form of "lazy tongs" gates 9 which are composed of vertical bars 10 united by slidable crossed bars 11.

Catalano et al., U.S. Pat. No. 2,990,880 discloses a gate which includes as its main parts a mesh 12 and rails 14. The mesh 12 includes four sets of strips or links as compared with two sets in folding gates as theretofore known. Catalano teaches that as far back as anyone in the folding gate industry can remember, folding gates have been made with only two sets of strips, and it has been the universal belief until the Catalano invention that a smaller mesh could not be produced on the basic or standard construction of strips. Basic or standard construction includes two sets of strips such as shown in FIG. 1 as 24 and 26. All the strips 24 are parallel and lie in a common plane and similarly all of the strips 26 are parallel and lie in a common plane.

Mutch, U.S. Pat. No. 2,348,561 discloses yet another "lazy tongs" form of collapsible gate but which includes springs 41 and 42 in sleeves 38 and 39 which house telescopic rods 37 and 38. The springs have a normal tendency to slide the rods outwardly leaving the gate in an open position as shown in FIGS. 1 and 3. The gate is collapsed by lifting operating member 34 upwardly as shown in FIG. 2. Upon a downward push or force on the operating member 34 when in the position shown in FIG. 2 the rods 37 and 38 are forced inwardly in sleeves 39 and 40 against the normal outward thrust of the springs 41 and 42 at the same time said sleeves moving downwardly and opening the gate during this downward thrust.

Horn, U.S. Pat. No. 3,213,555 discloses a self-opening gate which may use a single folding or collapsible gate but preferably embodies two companion gates 14 and 15. Each gate is foldable or collapsible and comprises an upper normally horizontal rail 16 and a similar horizontal lower rail 17 and vertical pickets 18, these vertical pickets having upper ends crossing and pivotally connected at 19 to the upper rail 16. When a person walks from left to right along a boardwalk and toward the gates the depressible end portion of the boardwalk gradually swings or pivots down and tensions the springs 74. This causes the gate to move to the phantom open position shown in FIG. 3.

Kiesling, U.S. Pat. No. 2,433,763 discloses a vertically operating collapsible gate 31 which includes frame parts 15 and 16 which constitute channel members. This device discloses yet another "lazy tongs" arrangement. Kiesling employs a strong spring 25 which controls certain leftwardly and rightwardly loose play in the gate.

Newton, U.S. Pat. No. 3,722,140 discloses a vertical gate which includes a shaft 10 which carries three pulleys 12, 14 and 16 which are secured to the shaft for rotation. Barrier members 32 are secured to cables 24 and 26. In operation, the gate normally assumes the position shown in FIGS. 1 and 2 with cables 24 and 26 maintaining the barrier members in a raised or closed position to prevent livestock or the like from passing through the gate with the cables 40 and 42 supporting the free ends of the treadle means 34 and 36 in a raised position. To open the gate, the operator of a vehicle merely drives the vehicle onto the treadle means 34, as shown in FIG. 3. The weight of the vehicle depresses the inner end of the treadle means 34 and acts through cables 40 and pulleys 12 to rotate the shaft 10 and the pulleys 14 and 16. Rotation of the pulley 16 acts to raise the counter-weights 28 and 30 to increase their potential energy, allowing the barrier means 32 to fall under the force of gravity to a collapsed position.

There remains a need for an expandable gate which easily opens to an expanded open position and easily and automatically closes to a compact closed position. There further remains a need for an expandable gate which eliminates the need to utilize the "lazy tongs" type of design which is often prone to causing pinching injuries by the scissor action of the gate bar members.

SUMMARY OF THE INVENTION

The present invention in its simplest form provides an expandable gate comprising: a plurality of vertical bar members extending from said top guide rod to said bottom guide rod, each of said bar members having a top guide rod slot and a bottom guide bar slot, said top guide rod extending through each of said top guide rod slots and said bottom guide rod extending through each of said bottom guide rod slots whereby said bar members may slide horizontally on said top and bottom guide rod members between an open expanded position where the bars are spaced further apart from one another and a closed collapsed position where the bars are closer together, said bar member each having a plurality of spring connection holes at spaced locations between said top guide rod slot and said bottom guide rod slot; a plurality of elongated flexible tension bar springs which lie flat when no forces are applied to said springs, each of said bar spring having a central opening and having an elongated upper end opening and an elongated lower end opening, said springs having overlapping ends and positioned between adjacent bar members; first connectors which rigidly attach a central portion of each spring to a bar member, and second connectors which slidingly attach an upper end portion and a lower end portion of each spring to a bar member whereby said springs urge said vertical bar members to move closer together to said collapsed closed position.

Preferably, a top horizontal guide rod and a bottom horizontal guide rod are also provided for stability. Preferably, said elongated upper end opening and said elongated lower end opening each have a medial end and a distal end whereby when said gate is in a closed position said second connectors are juxtaposed to said medial end of said elongated openings and when said gate is in a open position said second connectors are juxtaposed to said distal end of said elongated openings.

Preferably, adjacent vertical spring members between adjacent vertical bar members lie in a generally sinusoidal configuration when said adjacent bar members are moved further apart to an open position and said spring members lie in a generally straight line configuration when said bar members are moved to a closed position.

Preferably, a first spring member forms crest portion consisting of a first half of a sine wave configuration and a second vertically adjacent spring member forms a valley portion consisting of a second half of said sine wave configuration.

Preferably, said second connectors extend through said elongated upper end opening and one of said spring connection holes and extend through said elongated lower end opening and one of said spring connection holes.

Preferably, said vertical bar members each have a generally rectangular cross sectional configuration Preferably, said rod members each have a generally circular cross sectional configuration and, in one embodiment of the invention, each of said rod member guide slots have a partial circular cross sectional configuration. In another embodiment of the invention, said rod members each have a generally rectangular cross sectional configuration and each of said rod member guide slots have a corresponding rectangular cross sectional configuration. Preferably, however, said rod members each have a generally circular cross sectional configuration and each of said rod member guide slots are in the form of guide holes which have a circular cross sectional configuration.

In one embodiment of the invention, said first connectors extend through said central openings and through one of said spring connection holes and said first connectors are in the form of rivets. Preferably, said first connectors extend through said central openings and through one of said spring connection holes and said first connectors are in the form of bolts and nuts. In another embodiment of the invention, said first connectors are in the form of clips. In yet another embodiment of the invention, said first connectors are in the form of welding material which permanently attaches a central portion of each spring to a bar member.

In one embodiment of the invention, said second connectors are in the form of rivets which have heads spaced on a rivet shaft so as to allow sliding movement of the upper end portion and lower end portion of the spring relative to the bar to which it is attached. Preferably, said second connectors are in the form of bolts and nuts which are left in a loosened position so as to allow sliding movement of the upper end portion and lower end portion of the spring relative to the bar to which it is attached.

Preferably, said bar members are formed from a metal material selected from the group consisting of stainless steel, aluminum, stainless steel alloy and aluminum alloy.

Preferably, said spring members are formed from a flat steel spring material having a thickness in the range of 0.2 to 2.0 mm.

BRIEF DESCRIPTION OF THE DRAWINGS

FIG. 7Aa is a cross sectional view of a first connector.

FIG. 7B is a perspective view of an alternative embodiment of the first connector.

FIG. is 7C is a cross-sectional view of a second connector.

FIG. 7D is a cross-sectional view of an alternative embodiment of the second connector with the gate in a closed position.

FIG. 7E is a cross-sectional view of the alternative embodiment of the second connector with the gate in an open position.

Figures 8A, 8B, 8C:
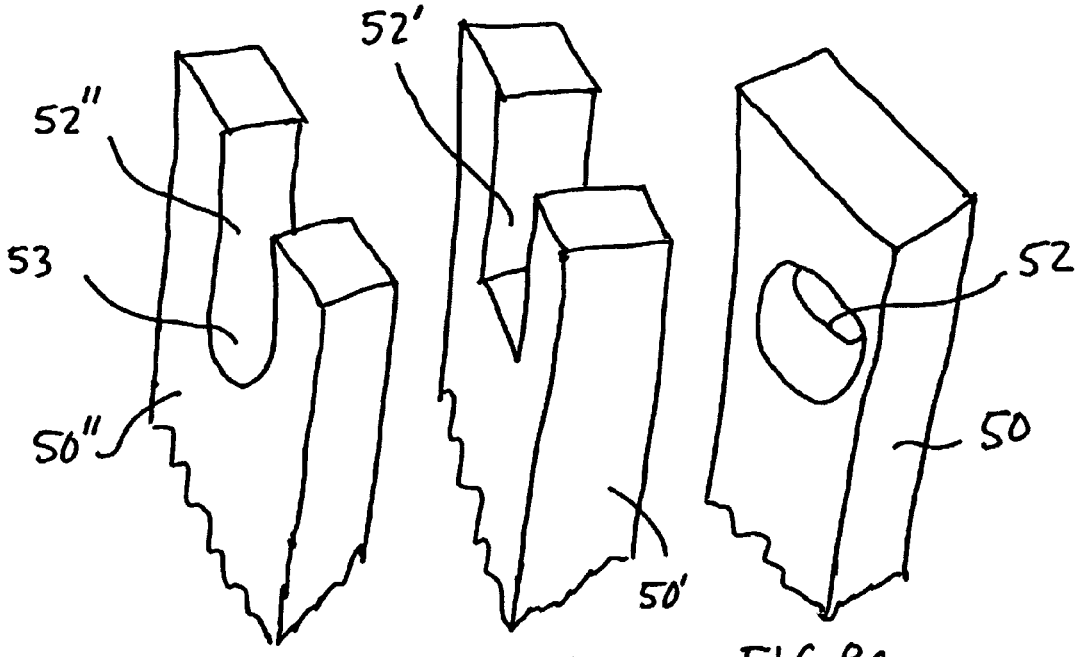

FIG. 8A is a perspective view of an end of a vertical bar member having a guide slot in a circular configuration.

FIG. 8B is a perspective view of an end of an alternative embodiment of the vertical bar member having a guide slots having a generally rectangular configuration.

FIG. 8C is a perspective view of an end of a vertical bar member having a guide slot in a partial circular configuration.

Figure 9:
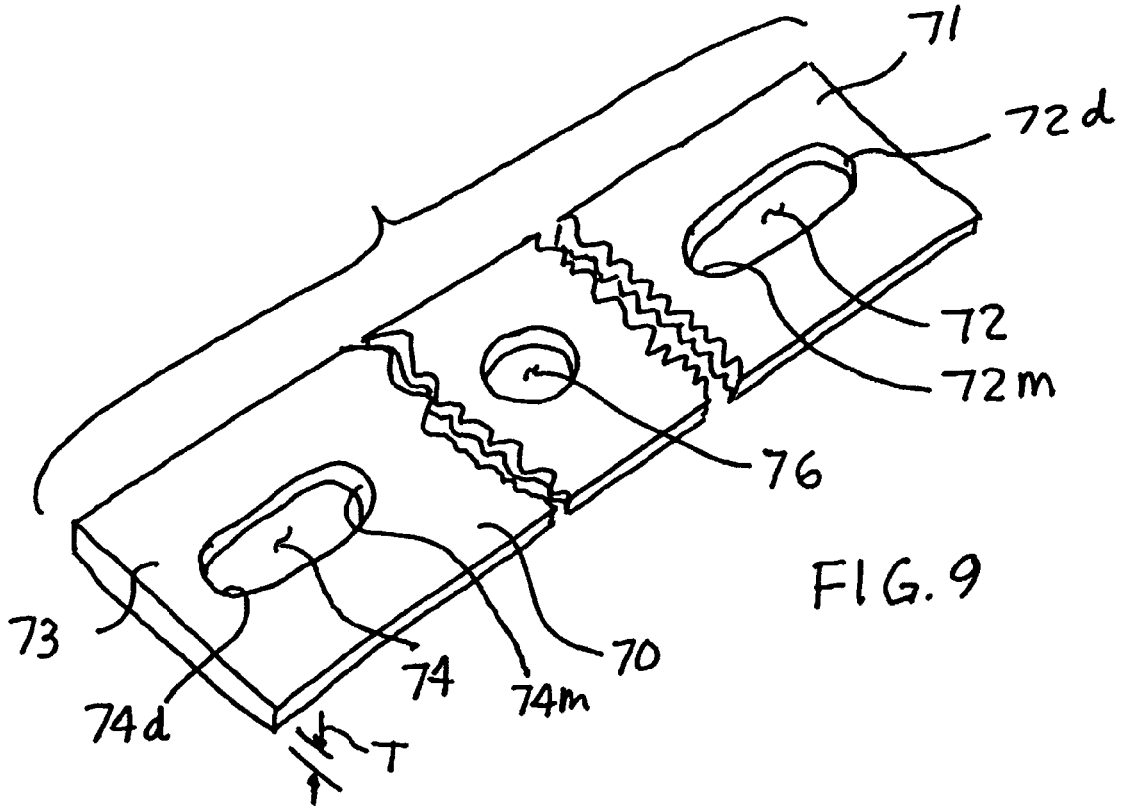

FIG. 9 is a perspective view in broken form showing end portions of a spring member having elongated openings therein and a central portion having a circular opening therein.

DETAILED DESCRIPTION OF THE PREFERRED EMBODIMENTS

Figure 1:
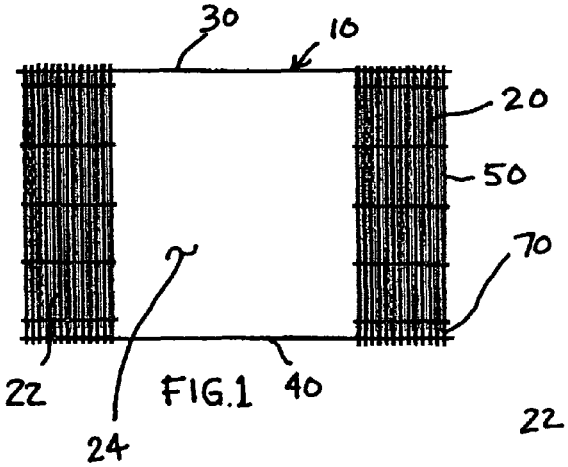
FIG. 1 is a front elevation view showing an expandable gate having gate panels in an open position.

Referring to FIG. 1, the gate 10 of the present invention is shown having panels 20 and 22 each in a closed collapsed position. The panel members 20 and 22 are each formed from a plurality of parallel vertical bar members 20 which are supported by a top horizontal guide rod 30 and a bottom horizontal guide rod 40. A plurality of elongated flexible tension bar springs 70 are positioned between adjacent bar members 50. As shown in FIG. 1, the bar members 50 are positioned very close together in a compact arrangement allowing for a large opening 24 to be created between the panel members 20 and 22 thereby creating a passageway through the gate. As will be explained in greater detail, the spring members 52 act to urge or keep the panel members 20 and 22 in the closed collapsed position unless outside forces are applied to the panels.

Figure 2:
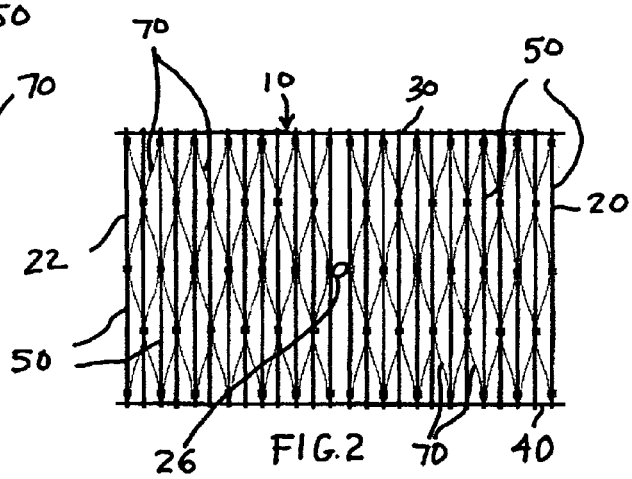
FIG. 2 is a front elevation view showing an expandable gate having gate panels in a closed position.

Referring to FIG. 2, the panel members 20 and 22 are each shown in an open expanded position and are held in such position by a suitable latch mechanism 26 which prevents the panels from returning to the position of FIG. 1. As can be seen, the spring members 70 which are provided between adjacent vertical bar members 50 are arranged in a generally sinusoidal configuration.

Figure 3:
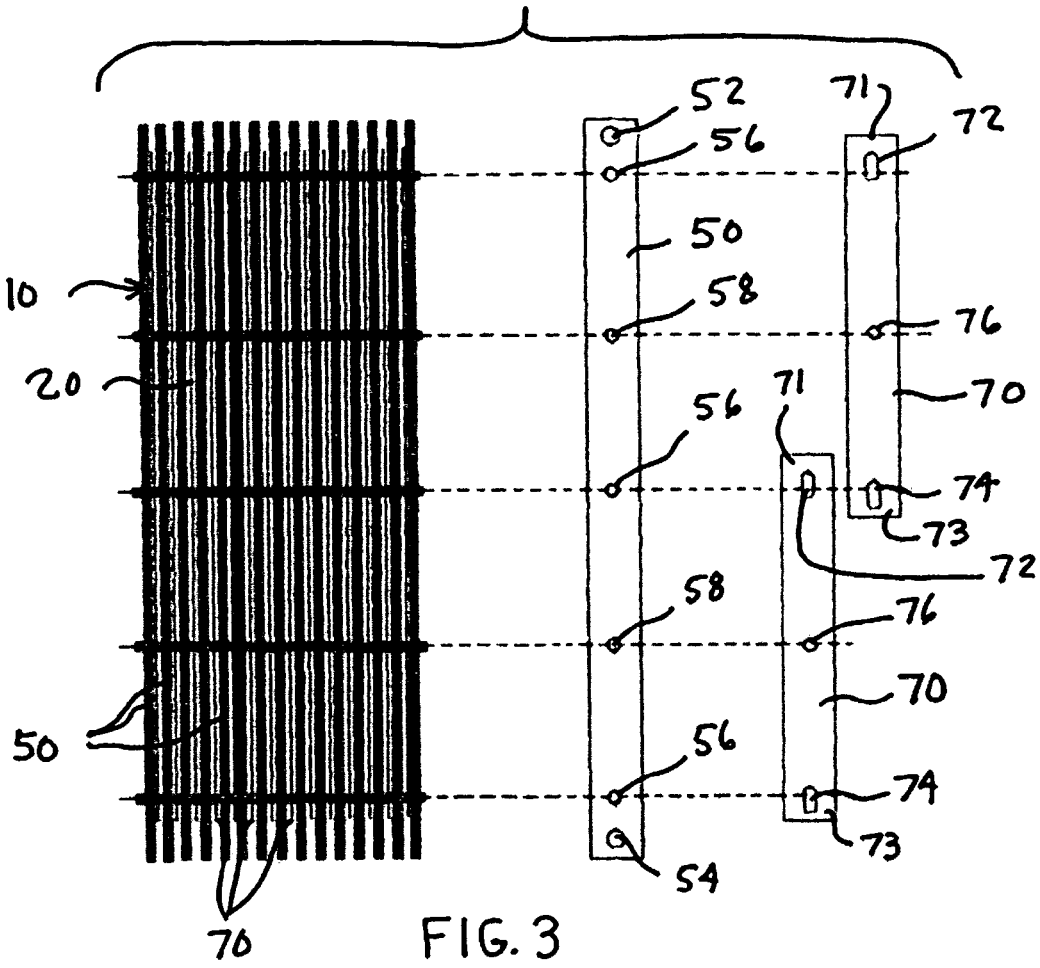
FIG. 3 is a schematic view showing the location of the vertical bar members and spring members.

Referring to FIG. 3, further details of the vertical bar members 50 and the spring members 70 or shown. The vertical bar members 50 include a top guide rod slot 52 and a bottom guide rod slot 54. The top horizontal guide rod 30 is placed in the guide rod slot 52 and the bottom guide rod 40 is placed in the bottom guide rod slot 54 in a manner which allows the vertical bar members 50 to freely slide to the left and to the right in a horizontal direction. The vertical bar members 50 also include a plurality of spring connection holes 56 and 58 at spaced locations between the top guide rod slot 52 and bottom guide rod slot 54. As will become apparent, spring connection holes 56 will be used in combination with elongated openings 72 and 74 of spring 70 whereas spring connection holes 58 will be used in combination with circular hole 76 of the spring 70. As shown, and upper elongated opening 72 is provided at an upper end 71 of spring 70 and a lower elongated opening 74 is provided at a lower end 73 of the bar spring 70.

Figure 4:
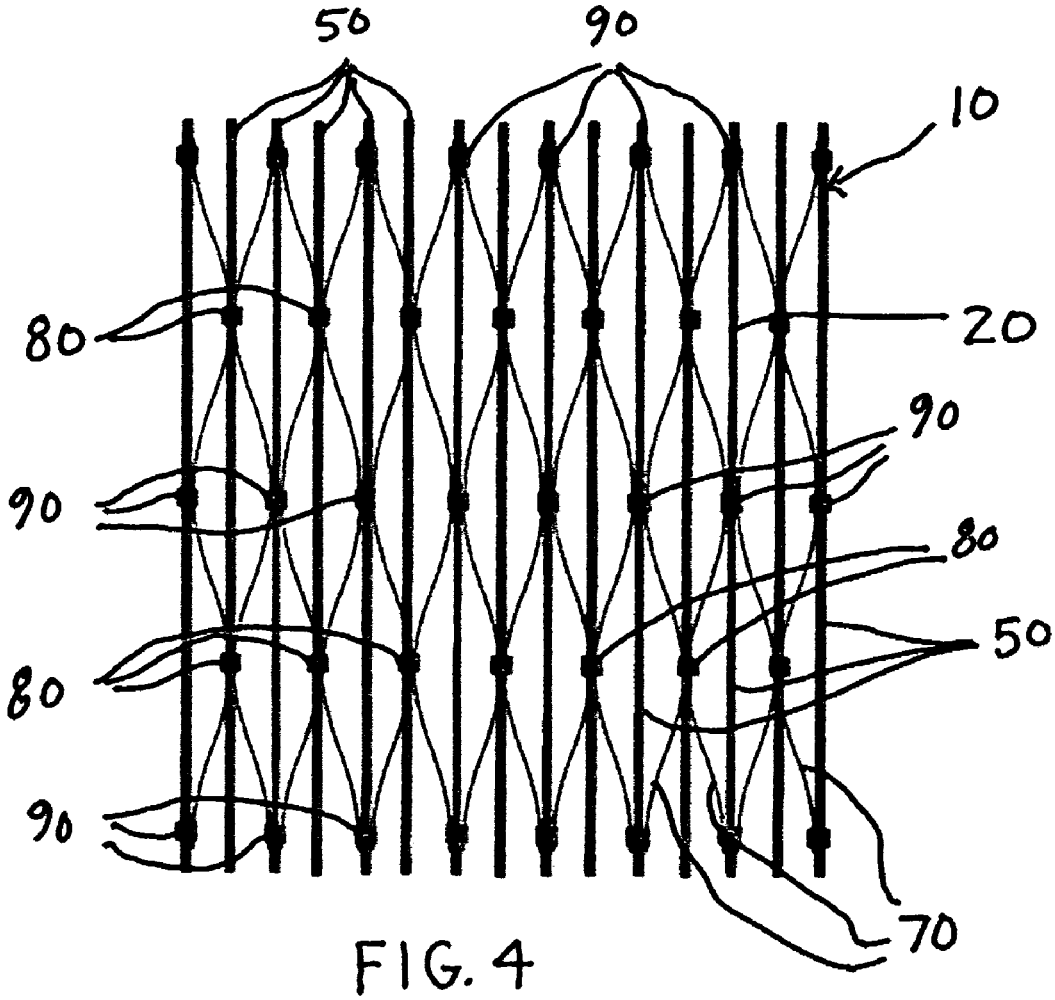
FIG. 4 is a front elevation view of a gate panel in an open position.

FIG. 4 shows gate panel 20 in an open expanded position and it shows the location of first connectors 80 and second connectors 90. FIG. 4 also illustrates the sinusoidal configuration of adjacent vertical spring 70 between adjacent vertical bar members 50.

Figure 5:
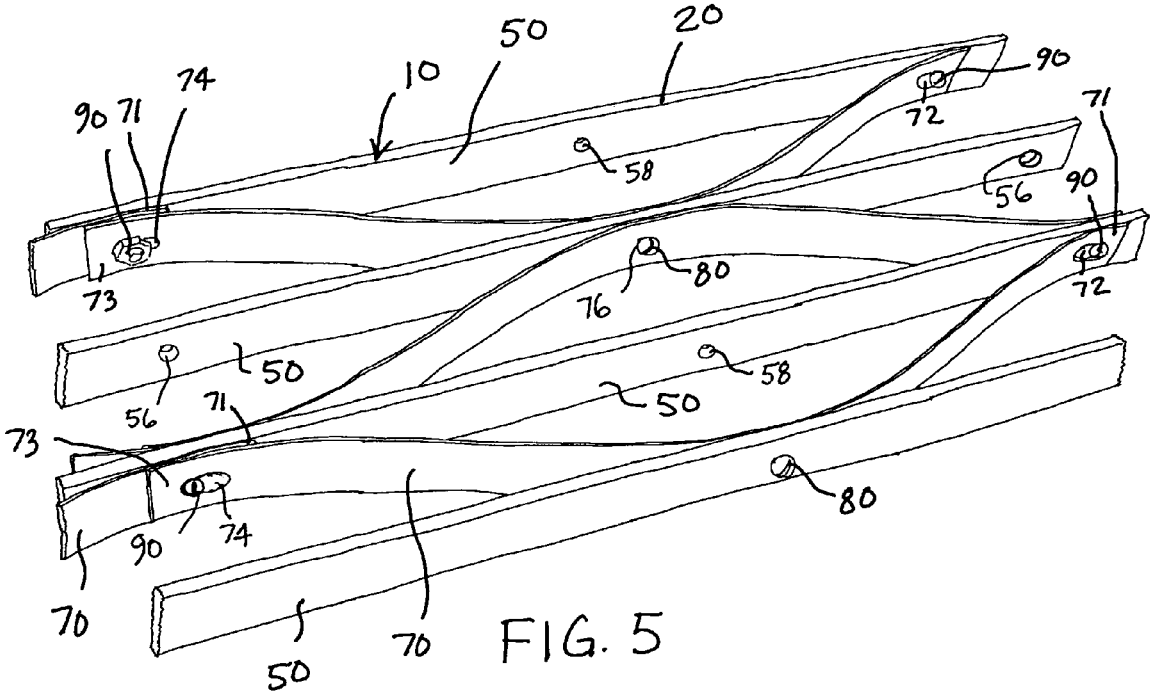
FIG. 5 is a perspective view of a portion of a gate panel in an open position.

FIG. 5 shows that a central portion of the spring 70 is securely and rigidly attached to the bar member 50 by use of a first connector 80 which extends through opening 58 in the bar member 50 and extends through opening 76 in the spring members 70 and is tightened in position. End 71 of spring 70 is slidingly attached to bar member 50 by a connector 90 which extends through elongated opening 72 of springs 70 and through circular opening 56 of bar member 50. Similarly, end 73 of spring 70 is slidingly attached to the bar member 50 by a connector 90 which extends through elongated opening 74 of spring 70 and through circular opening 56 of bar member 50.

Figure 6:
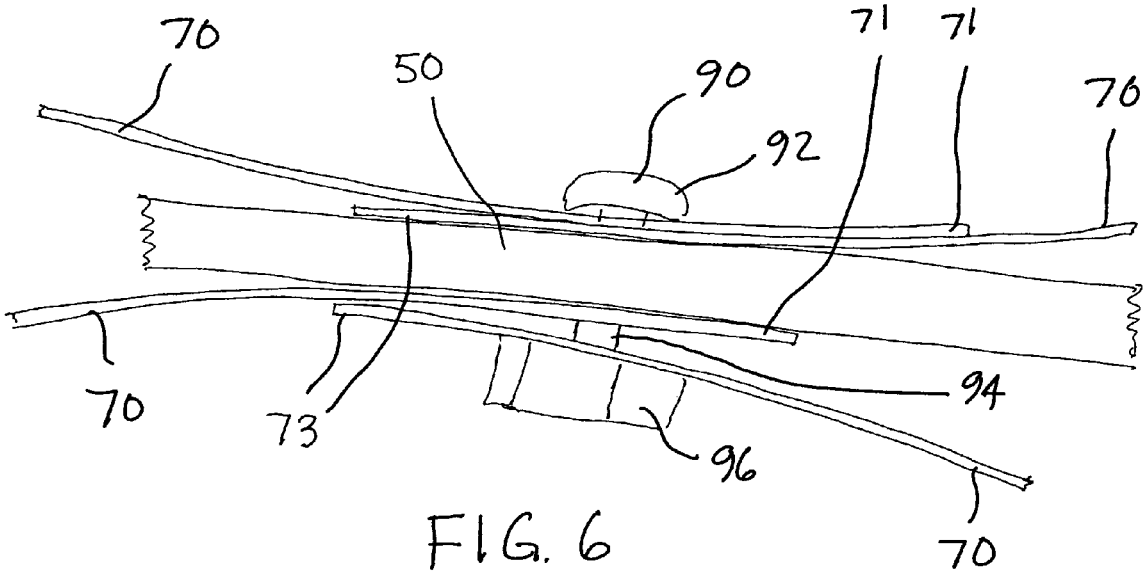
FIG. 6 is a side elevation of view showing the sliding attachment of overlapping springs to a vertical bar member.

FIG. 6 shows the details of the connection of the spring ends 71 and 73 to the bar member 50. As shown, adjacent vertical spring 70 have ends 71 and 73 which overlap. The connector 90 has a head 92, a shaft 94 and a nut 96. It is to be understood that a nut 96 connector 90 is not fully tightened so as to allow the ends 71 and 73 of spring 72 slide relative to the bar member 50.

FIGS. 7A through 7E show various forms of the first connector 80 and second connector 90 of the present invention. For the sake of simplicity some of these figures show springs 70 attached to only one side of bar member 50 but it is to be understood that for all interior bar member connections, the springs 70 will be attached to both sides of the bar 50 as shown in FIG. 7E. Further, these figures show the connectors in the form of rivets 80, 90' and in the form of a nut and bolt 90. It is to be understood that such connectors may be interchanged for the desired usage. Referring specifically to FIG. 7A, a connector 80 in the form of a rivet which has a first head 82, a shaft portion 84 and second head 86 is used to tightly and rigidly secure the center portion of springs 70 to the bar 50. As shown, the shaft portion 84 extends through opening 58 in bar 50 as well as through openings 76 in the overlapping springs 70. The heads 82 and 86 tightly squeeze these components together. If a bolt and nut arrangement such as shown in 7C were used for this purpose, the nut would be securely tightened onto the bolt.

FIG. 7B shows a clip member 80' which includes a central portion 84' and spaced apart like members 82' and 86'. These leg members are designed to tightly squeeze the components together in the same manner as described in FIG. 7A.

FIG. 7C shows a second connector 90 which has a head 92 a shaft portion 94 and a nut portion 96 which in this case is left in a semi-loose position to allow for sliding movement of the components. The shaft portion 94 extends through opening 56 of bar 50 and through opening 72 of bar member 70 and opening 74 of overlapping bar member 70. In this case, because the gate is shown in a closed collapsed position the shaft 94 is juxtaposed immediately adjacent medial end 72*m* of elongated opening 72 and immediately adjacent to medial end 74*m* of elongated opening 74. The shaft 94 is spaced from the distal ends 72*d* and 74*d* of said openings. It will be obvious to those of ordinary skill in the art that changing the size of the elongated openings and thus the distance between the medial ends and distal ends of such openings will allow control as to how far apart the vertical bar members 50 will be allowed to travel when the gate panel 20 is urged to an open expanded position.

FIG. 7D is identical to FIG. 7C but for the replacement of connector 90 with connector 90' which is in the form of a rivet which has a shaft 94' of sufficient length so that the heads 92' and 96' do not impinge upon the components that allow them to freely slide relative to one another.

FIG. 7E is similar to FIG. 7D but shows the springs 70 in a flexed position when the gate is in its open expanded position. Note that in this position shaft 94' is adjacent the distal ends 72*d* and 74*d* and is spaced from the medial ends 72*m* and 74*m* of the elongated openings.

FIGS. 8A, 8B and 8C, respectively, show circular 52, rectangular 52' and partially circular 52" slot configurations in an upper and of bar members 50, 50', and 50". The cross-sectional configuration of the upper guide rod 30 and lower guide rod 40 may be circular, rectangular or any desired shape which allows the bar members 52 slide horizontally. While not preferred, it is to be understood that the gate of the present invention, while not as stable, will still operate and function with no top or bottom guide rods. This is true since the spring members 70 in combination with the first and second connectors are a sufficient structure to connect together and hold the bar members 50 in the desired closed collapsed and open expanded positions.

Finally, FIG. 9 shows a perspective view of a spring bar member 70 which has a thickness T and which shows the details of openings 72, 74 and 76.

While I have shown and described the presently preferred embodiment of my invention, the invention is not limited thereto and may be otherwise variously practiced within the scope of the following claims:

I claim:

1. An expandable gate comprising:

a) a top horizontal guide rod;

b) a bottom horizontal guide rod;

c) a plurality of vertical bar members extending from said top guide rod to said bottom guide rod, each of said bar members having a top guide rod slot and a bottom guide bar slot, said top guide rod extending through each of said top guide rod slots and said bottom guide rod extending through each of said bottom guide rod slots whereby said bar members may slide horizontally on said top and bottom guide rod members between an open expanded position where the bars are spaced further apart from one another and a closed collapsed position where the bars are closer together, said bar member each having a plurality of spring connection holes at spaced locations between said top guide rod slot and said bottom guide rod slot;

d) a plurality of elongated flexible tension bar springs which lie flat when no forces are applied to said springs, each of said bar springs having a central opening and having an elongated upper end opening and an elongated lower end opening, said springs having overlapping ends and positioned between adjacent bar members;

e) first connectors which rigidly attach a central portion of each spring to a bar member, and f) second connectors which slidingly attach an upper end portion and a lower end portion of each spring to a bar member whereby said springs urge said vertical bar members to move closer together to said collapsed closed position.

2. An expandable gate according to claim 1 wherein said elongated upper end opening and said elongated lower end opening each have a medial end and a distal end whereby when said gate is in a closed position said second connectors are juxtaposed to said medial end of said elongated openings and when said gate is in a open position said second connectors are juxtaposed to said distal end of said elongated openings.

3. An expandable gate according to claim 1 wherein adjacent vertical spring members between adjacent vertical bar members lie in a generally sinusoidal configuration when said adjacent bar members are moved further apart to an open position and said spring members lie in a generally straight line configuration when said bar members are moved to a closed position.

4. An expandable gate according to claim 3 wherein a first spring member forms crest portion consisting of a first half of a sine wave configuration and a second vertically adjacent spring member forms a valley portion consisting of a second half of said sine wave configuration.

5. An expandable gate according to claim 1 wherein said second connectors extend through said elongated upper end opening and one of said spring connection holes and extend through said elongated lower end opening and one of said spring connection holes.

6. An expandable gate according to claim 1 wherein said vertical bar members each have a generally rectangular cross sectional configuration.

7. An expandable gate according to claim 1 wherein said rod members each have a generally circular cross sectional configuration and each of said rod member guide slots have a partial circular cross sectional configuration.

8. An expandable gate according to claim 1 wherein said rod members each have a generally rectangular cross sectional configuration and each of said rod member guide slots have a corresponding rectangular cross sectional configuration.

9. An expandable gate according to claim 1 wherein said rod members each have a generally circular cross sectional configuration and each of said rod member guide slots are in the form of guide holes which have a circular cross sectional configuration.

10. An expandable gate according to claim 1 wherein said first connectors extend through said central openings and through one of said spring connection holes and said first connectors are in the form of rivets.

11. An expandable gate according to claim 1 wherein said first connectors extend through said central openings and through one of said spring connection holes and said first connectors are in the form of bolts and nuts.

12. An expandable gate according to claim 1 wherein said first connectors are in the form of clips.

13. An expandable gate according to claim 1 wherein said first connectors are in the form of welding material which permanently attaches a central portion of each spring to a bar member.

14. An expandable gate according to claim 1 wherein said second connectors are in the form of rivets which have heads spaced on a rivet shaft so as to allow sliding movement of the upper end portion and lower end portion of the spring relative to the bar to which it is attached.

15. An expandable gate according to claim 1 wherein said second connectors are in the form of bolts and nuts which are in a loosened position so as to allow sliding movement of the upper end portion and lower end portion of the spring relative to the bar to which it is attached.

16. An expandable gate according to claim 1 wherein said bar members are formed from a metal material selected from the group consisting of stainless steel, aluminum, stainless steel alloy and aluminum alloy.

17. An expandable gate according to claim 1 wherein said spring members are formed from a flat steel spring material having a thickness in the range of 0.2 to 2.0 mm.

18. An expandable gate comprising:

a) a plurality of vertical bar members whereby said bar members may slide horizontally between an open expanded position where the bars are spaced further apart from one another and a closed collapsed position where the bars are closer together, said bar members each having a plurality of spring connection holes at spaced locations;

b) a plurality of elongated flexible tension bar springs which lie flat when no forces are applied to said springs, each of said bar spring having a central opening and having an elongated upper end opening and an elongated lower end opening, said springs having overlapping ends and positioned between adjacent bar members;

c) first connectors which rigidly attach a central portion of each spring to a bar member, and d) second connectors which slidingly attach an upper end portion and a lower end portion of each spring to a bar member whereby said springs urge said vertical bar members to move closer together to said collapsed closed position.

* * * * *